US006360420B2

(12) United States Patent
Shah et al.

(10) Patent No.: US 6,360,420 B2
(45) Date of Patent: Mar. 26, 2002

(54) INSULATED GLASS WINDOW SPACER AND METHOD FOR MAKING WINDOW SPACER

(75) Inventors: Ashok Shah, Naperville; Richard Blum, Bolingbrook; Gary Dickinson, River Grove, all of IL (US)

(73) Assignee: Met-Coil Systems Corporation, Westfield, MA (US)

( * ) Notice: Subject to any disclaimer, the term of this patent is extended or adjusted under 35 U.S.C. 154(b) by 0 days.

(21) Appl. No.: 09/851,166

(22) Filed: May 9, 2001

Related U.S. Application Data

(60) Division of application No. 09/488,544, filed on Jan. 21, 2000, now Pat. No. 6,279,292, which is a continuation-in-part of application No. 08/604,372, filed on Feb. 21, 1996, now Pat. No. 6,038,825.

(51) Int. Cl.[7] ..... B21D 47/00

(52) U.S. Cl. ..... 29/458; 29/428; 29/527.2; 29/897.32

(58) Field of Search ..... 29/897.32, 897.312, 29/558, 430, 469.5, 505, 557, 527.6, 527.7, 527.2, 428, 458; 52/786.13, 172, 656.2, 658; 428/34

(56) References Cited

U.S. PATENT DOCUMENTS 2,462,199 A * 2/1949 Kehoe et al. ..... 29/897.312
3,478,483 A * 11/1969 Baker ..... 52/658
3,867,107 A * 2/1975 Long et al. ..... 52/658
4,574,553 A * 3/1986 Lisec ..... 52/658
5,361,476 A * 11/1994 Leopold ..... 29/458
5,501,013 A * 3/1996 Misera ..... 29/897.312
5,655,282 A * 8/1997 Hodek et al. ..... 29/469.5

FOREIGN PATENT DOCUMENTS

DE 3325718 * 1/1985 ..... 29/428

* cited by examiner

*Primary Examiner*—Michael Safavi
(74) *Attorney, Agent, or Firm*—McCormick, Paulding & Huber LLP

(57) ABSTRACT

An integral metal spacer for insulated glass units and method of fabricating the spacer. The spacer defines a substantially closed cross-section contour having a bottom surface, a pair of sidewalls, and a pair of generally abutting inner surfaces. A gap may be defined between the adjacent inner surfaces. The three interior corners are defined by fully mitered sidewalls. A pair of bridges are provided to integrally interconnect the inner surfaces of adjacent spacer segments. The method of fabricating includes taking a roll of flat metal stock and completely punching all corner and other structures therein while the stock is planar; severing the punched stock into individual spacer members; roll-forming the individual members into a finished linear spacer piece; applying desiccant during roll-forming; applying sealant; thereafter folding the elongate member into a square spacer thereby locking the desiccant therein.

14 Claims, 4 Drawing Sheets

120a
120b
114

118
116
114

10
12
14
16
18
20
24
26
28
30
62
62
64
80
82
86
89
110
112
114

INSULATED GLASS WINDOW SPACER AND METHOD FOR MAKING WINDOW SPACER

RELATED APPLICATION

This is a division of application Ser. No. 09/488,544 filed Jan. 21, 2000, now U.S. Pat. No. 6,279,292 issued Aug. 28, 2001, which is a continuation-in-part of U.S. Ser. No. 08/604,372 filed Feb. 21, 1996, now U.S. Pat. No. 6,038,825 issued Mar. 21, 2000.

FIELD OF INVENTION

The present invention relates to multiple pane insulated glass windows (generally referred to in the industry as insulated glass units or "IGUs") and more particularly to the spacers that are positioned around the perimeter region of the IGU and serve to position the individual window lights ("panes") in spaced-apart parallel relationship and to seal the interior region of the IGU against the ingress of moisture-laden air.

BACKGROUND OF INVENTION

A variety of spacers have been proposed and utilized for IGUs including metal spacers as well as spacers fabricated from plastic or other insulative material. The present invention relates to metallic spacers.

By way of a brief review of spacer development, early spacers were assembled from four individual linear spacer members. These members were connected at their ends to define right-angle corners thereby forming a complete rectangular spacer. More specifically, molded plastic or fabricated metal corner segments, generally referred to as "corner keys", were employed to join the individual spacer members and to retain the requisite rectangular shape. Illustrative of this spacer technology are U.S. Pat. Nos. 2,173,664; 3,105,274; 3,280,523; 3,380,145; and 4,080,482.

Pre-formed corner keys, however, require that the spacer be fully assembled in its finished rectangular form prior to application of the sealant to each of the spacer's four segments. Sealant applicators or extruders must therefore apply the sealant one segment at a time as the spacer is rotated or "cartwheeled" to orient successive segments in position adjacent the sealant applicator.

To avoid the complexities of cartwheel sealant application, a "folding" variation of the corner key was developed. Folding keys are inserted into the respective spacer segment ends in a "linear" configuration, thereafter, the several corners may be deformed or folded to complete each right-angle corner. One advantage of this approach is the retention of a linear geometry, i.e., the four interconnected segments are laid-out and retained in an elongate, linear configuration and may therefore be fed to a "linear extruder" for the application of sealant in this linear form. Linear sealant extruders are less complex and expensive than their cartwheel counterparts. The spacer, following sealant application, is thereafter folded to its finished rectangular form. Examples of folding corner keys may be seen in U.S. Pat. Nos. 4,357,744; 4,513,546; 4,530,195 and 4,546,723.

The field of "integral" or "continuous" spacers represents the next and logical extension of spacer technology. The present invention pertains to integral spacers. Integral spacers are characterized by a single, generally metallic, member of length equal to the perimeter of the associated IGU and having "corner structures" integrally formed along the length thereof whereby the single spacer structure will be bent and formed, at appropriate time, into its finished rectangular form.

It will be appreciated that integral spacers offer several advantages over their multi-member ancestors including their inherent suitability for linear extrusion (of sealant); the ease of handling a single member structure; and the concomitant savings in both assembly time and material cost (as separate corner keys are not required).

Not surprisingly a myriad of integral spacer topologies have been proposed. U.S. Pat. Nos. 4,431,691 and 4,597,232 suggest radiussed corners, apparently in lieu of so-called "corner structures" found in the remaining integral spacers considered hereinafter. The uncontrolled bending of material to form a corner, however, invariably causes deformation or buckling of the spacer sidewalls in the corner region which, in turn, renders it difficult to seal the spacer to the planar glass surface.

For this reason, virtually all known integral spacers have incorporated appropriate "corner structures" to eliminate or minimize this material deformation in the corner regions. One well-known approach has been the use of fully mitered corners in which all sidewall material that would otherwise "interfere" or "deform" upon spacer folding is physically removed prior to folding. The opposed end surfaces of the adjacent spacer sidewalls abut in a "picture-frame" like manner without actual, forceful engagement there between.

Some of the earliest uses of the fully mitered corner may be found in the present applicants' own "filter frame" products in which plural "miter-defining" notches were stamped at appropriate spaced locations along a single elongate member which member was thereafter roll-formed into a U-shaped channel and folded into a finished rectangular filter-element retaining frame member. See U.S. Pat. Nos. 2,869,694; 3,478,483; and 4,084,720. Examples of fully mitered corners found in window spacers can be found in the "Super Spacer" (a product and trademark of Edgetech I.G. Ltd. of Ottawa, Canada); United Kingdom Patent Application No. 2 104 139 A; United Kingdom Patent No. 349,875; and French Patent Specification No. 2,449,222.

Most recent vintage integral spacers have departed from the fully mitered corner and have, instead, adopted various "corner structures" in which some portion or all of the sidewall material associated with the corner region is retained. As noted, to assure a proper gas-tight seal to the window panes, the outside surfaces of the sidewalls must remain substantially planar through the corner regions and consequently the excess sidewall corner material must be made to buckle inwardly to form interior "pleats".

To this end, "weak zones" have been described, for example, by stamping a plurality of radial "score lines" into the sidewalls—at the corner regions thereof—preferably while the spacer stock remains flat, i.e., prior to the roll-formation of its U-shaped cross-section. To assure that these weak zones buckle correctly (i.e., inwardly), the weak zones are "deformed, or dished, inwardly" prior to spacer folding (corner formation).

Applicants refer to these integral spacers—in which the integrity of the sidewall is maintained throughout the corner—as continuous sidewall spacers. Examples include U.S. Pat. Nos. 5,255,481; 5,295,292; 5,313,761, and 5,351,451.

It will be observed that each of the above-listed continuous sidewall spacers share a common structural feature, namely, an open-interior U-shaped cross-section. originally spacers were of a closed-form design in order to retain the desiccant pellets therein. With the subsequent development of pumpable desiccant matrices that contain adhesive, or to which adhesive may be applied, it is no longer necessary to close the inwardly facing surface of the spacer—the desiccant matrix is literally glued within the spacer channel—whether of a closed or an open, U-shaped form.

The U-shaped spacer topology offers several fabrication-related advantages including the previously noted ease and flexibility of desiccant application, i.e., the ability to apply the desiccant before, during, or after formation of the channel itself. But of potentially greater significance is the "absence" of the fourth side, i.e., the inner surface, which surface would "bunch-up" thereby interfering with the folding formation of the corner. Clearly, urging further pleats into the corner interior—as would be required of a fully enclosed, four-sided spacer—would result in pleat interference and the unpredictable and uncontrolled deformation of the corner sidewalls.

"Notwithstanding these limitations, a few fully enclosed, integral spacers have been developed. Such spacers generally include a "block" or "plug" positioned within the spacer channel at, or adjacent to, the corner regions to retain the desiccant, thereafter, a fully mitered notch is made through both sidewalls and the fourth or inner surface. In this manner, the corners of the fully enclosed integral spacer may be formed by the conventional folding thereof without the destructive interference caused by the buckling of the sidewalls or inner wall. Exemplary of this spacer is the spacer manufactured on the model RDF-1 system, itself manufactured by Besten, Inc. of Chagrin Falls, Ohio. Besten also manufactured a model RDF-2 system that produced a similar fully enclosed spacer, but where the spacer's "corner structure" notches were punched prior to spacer roll-forming."

SUMMARY OF THE INVENTION

The present invention pertains to a substantially enclosed integral spacer that seeks to achieve the efficiencies of integral construction but without certain of the manufacturing and other restrictions associated with the above-described implementations. For example, the visibly open interior of the U-shaped integral spacer is deemed aesthetically unattractive by many. The interior of the spacer and desiccant—even if uniformly applied—remains visible. Further, desiccant must be applied around all four sides otherwise a discontinuity of appearance will result. Finally, in the event that the desiccant matrix becomes dislodged—not an uncommon malady—it may droop into the center of the IGU representing an obviously unsightly window malfunction.

By contrast, the present spacer employs a generally enclosed cross-sectional contour which presents the more customary and arguably desirable "finished" appearance. And by reason of its closed form, desiccant need not be adhered to the spacer and will remain within the spacer even without adhesive. Indeed, the preferred embodiment of the present invention utilizes a desiccant material which may be inserted into the spacer during roll-forming and is retained within the spacer as explained more fully below.

A principal limitation of the Besten-type fully enclosed spacer is its limited corner rigidity. While fully mitered corners, such as taught by Besten, obviate any bunching of the side/innerwalls and corresponding corner deformation, the very absence of this material leaves but the single outside wall to rigidly interconnect the respective spacer segments. By contrast, the continuous sidewall structure of the previously considered U-shaped spacers provide enhanced corner integrity. Another problem associated with the fully mitered corner of Besten relates to the roll-forming process and, specifically, to the fact that deformation of the sidewalls may occur in the immediate vicinity of the corner. This deformation is occasioned by the travel of the spacer through and past the "rolls" that comprise the roll-forming apparatus itself. As noted, such deformations may impair the gas-tight seal in the corner regions. Finally, the placement of desiccant-restraining plugs or blocks represents added complexity and cost in connection with both the manufacturing apparatus as well as the finished spacer product.

The present spacer avoids many of above-noted problems while nevertheless defining an integral spacer of substantially closed cross-section. To this end, the present spacer adopts a fully mitered sidewall topology but, importantly, in combination with dual innerwall "bridges". These bridges serve several important functions including capturing the desiccant and blocking its travel within the spacer, forcing alignment between the ends of adjacent spacer segments, and adding strength and overall stability to the spacer.

The final roll-forming station advantageously applies an inward (i.e., downward) bias to the corner bridges as each spacer corner passes from the roll-former. In this manner, the bridges are predisposed to buckle inwardly as the corner is formed without having to apply an external dimpling force (or added dimpling station). It has been found that these self-dimpling bridges fold neatly inwardly thereby substantially closing the respective channel ends against movement of desiccant material therebetween.

In the preferred embodiment of the present spacer, a commercially available desiccant material is laid into the spacer during the roll-forming thereof, that is, before the closure of the inner spacer surface. (Actually it is preferred that the spacer never be "fully" closed, but rather, that a longitudinal aperture between the opposed edges of the inner surface be defined. This aperture facilitates gas communication between the desiccant and the window interior as well as providing a thermal gap to limit the conduction of heat energy transversely across the spacer.) The diameter of the desiccant exceeds any gap left in the inner surface and therefore the desiccant cannot droop from the spacer as may occur with U-shaped spacers. It will be understood that these bridges additionally lock the desiccant against longitudinal travel within the spacer and would similarly serve to restrain the movement or circulation of pellet or other desiccants throughout the spacer.

The bridges literally "bridge" or tie the ends of adjacent spacer segments together whereby any force applied laterally/transversely against one sidewall is communicated through the bridge to the corresponding sidewall of the adjacent spacer segment. Therefore, any transverse (inward or outward) movement of one side of a bridged sidewall pair will be replicated in the other of the sidewalls forming the bridged pair. In this manner, the planar relationship of the adjacent sidewalls is maintained and more accurate sealing of the spacer to the window pane results.

As noted, the single-surface interface defined by the Besten-type fully mitered corner provides little intrinsic strength, particularly in torsion. Bending and misalignment at the corners may occur. By contrast, the inner surface bridges of the present spacer cooperate with the outer spacer surface to define two spaced-apart planes of engagement between adjacent spacer segments thereby defining a moment-arm that tends to resist torsional deformation. In this manner, a fully mitered, substantially enclosed spacer is defined that exhibits structural properties comparable to spacers of the continuous sidewall variety but without the other limitations associated with the open U-shaped contour.

These and other objects are more fully explicated in the drawings, specification, and claims that follow.

DESCRIPTION OF PREFERRED EMBODIMENT

Figures 1, 10, 11:
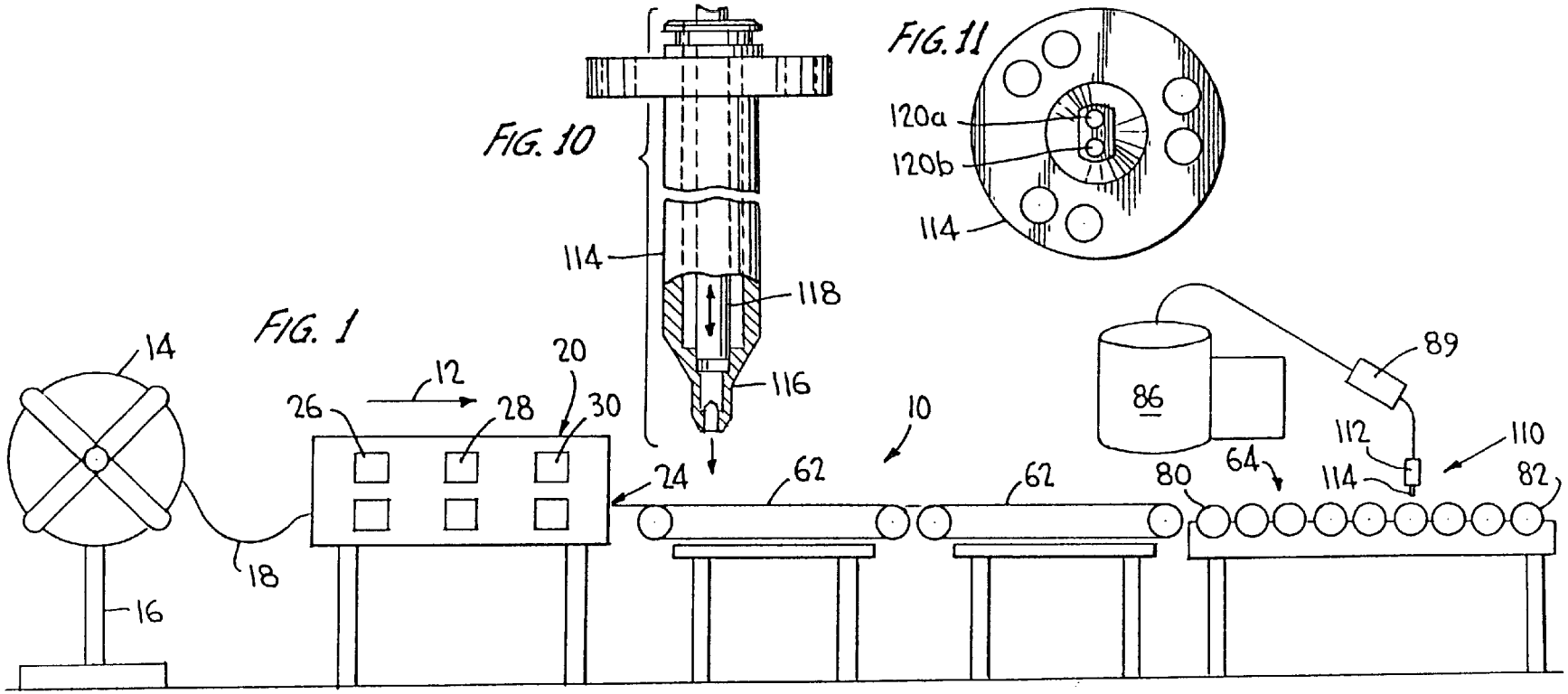
FIG. 1 is a side elevation view of the spacer fabrication system of the present invention.
FIG. 10 is a side view in partial cross-section of the desiccant dispensing nozzle.
FIG. 11 is a bottom view of the desiccant dispensing nozzle.

FIG. 1 illustrates the automatic integral spacer manufacturing system 10 of the present invention with arrow 12 representing the direction of material flow through the system. Spools of flat metal stock 14 are positioned on a material handling pedestal 16. This pedestal may be of either the horizontal or vertical spool-mounting variety and may be motorized as required. Pedestals 16 are well-known in the industry and commercially available.

As described more fully below, the width of the flat stock 14 is selected as required to produce a particular finished spacer width. It is contemplated that the present system 10 will be capable of fabricating a plurality of spacers of differing finished dimensions, differing not merely in overall length and width of the IGU, but in the dimension of the gas space between the respective IGU glass panes. Thus, metal spools 14 of correspondingly differing width will be, from time to time, substituted and positioned on pedestal 16 as required and appropriate to the particular finished spacer width then being manufactured.

The flat metal strip 18 is fed to the first material processing station, a multiple die stamping or punching press 20. As discussed below, a variety of die-cut apertures, notches, and other contours must be placed in the flat metal strip corresponding to the intermediate or interior (inner) corner structures, the spacer end structures, and the muntin retention notches. Further, the final station includes a spacer cut-off die.

It will be appreciated that while the flat stock material enters the first processing station 20 at 22 as a continuous strip of material, the punched and die-cut material is severed and exits station 20 at 24 as individual lengths of flat stock each of which will subsequently be roll-formed to define a single spacer. In this manner the remainder of the spacer fabrication may be handled and timed on a spacer-by-spacer basis thereby avoiding the necessity of "slack loops" or other metering and monitoring of material flow through the system. Indeed, the flexibility of this post die-punching severing into individual spacer blanks theoretically permits the bifurcation of the manufacturing process. Die-cut and severed spacer blanks can be run prior to and separately from the subsequent roll-formation and desiccant application phases of the overall system 10.

Die-cutting station 20 may be of either the "flying" or "stationary" head variety. In the former, the actual die-punching head is accelerated to the velocity of the moving flat stock material in order that the punching operation occur with no relative velocity between the punch and metal strip. Flying head punches require the added complexity associated with the movement of the head and the accurate control thereof, but offer the advantage of maintaining a constant velocity flow of flat stock material through the system.

In view of the above-noted post die-cutting processing of the stock as individual spacers, a constant velocity flow of material through the first station 20 is not deemed as important and therefore a stationary head system has been utilized in the preferred embodiment of the present invention. The flat stock does not flow through a stationary head system at continuous velocity but, instead, is repeatedly moved and stopped to precisely locate the required portions of the stock in proper position relative to each of the die-punch heads. The present applicants have manufactured multiple head die punching stations of both the flying and stationary head varieties. Equipment of this type is well-known and generally available to the industry except, of course, for the specific die contours to be cut thereon that define the present spacer. These contours are discussed in more detail below.

Three die-punch heads 26, 28, and 30 are illustrated. Each of these punch heads is fitted with appropriate dies corresponding to the particular spacer profile desired. One die-set, for example, punches the corner structures (for the three interior corners) into the flat stock. The stock must be advanced and stopped three times in order that all three interior corner structures be punched. The position of each such corner punch, and the distance between punches, is software controlled and determined in accordance with the overall length and width of the IGU in connection with which the spacer is being manufactured. A separate die-punch head is used for the muntin notches and a third head punches the respective mating end contours and to sever the previously punched spacer.

Figure 2A:
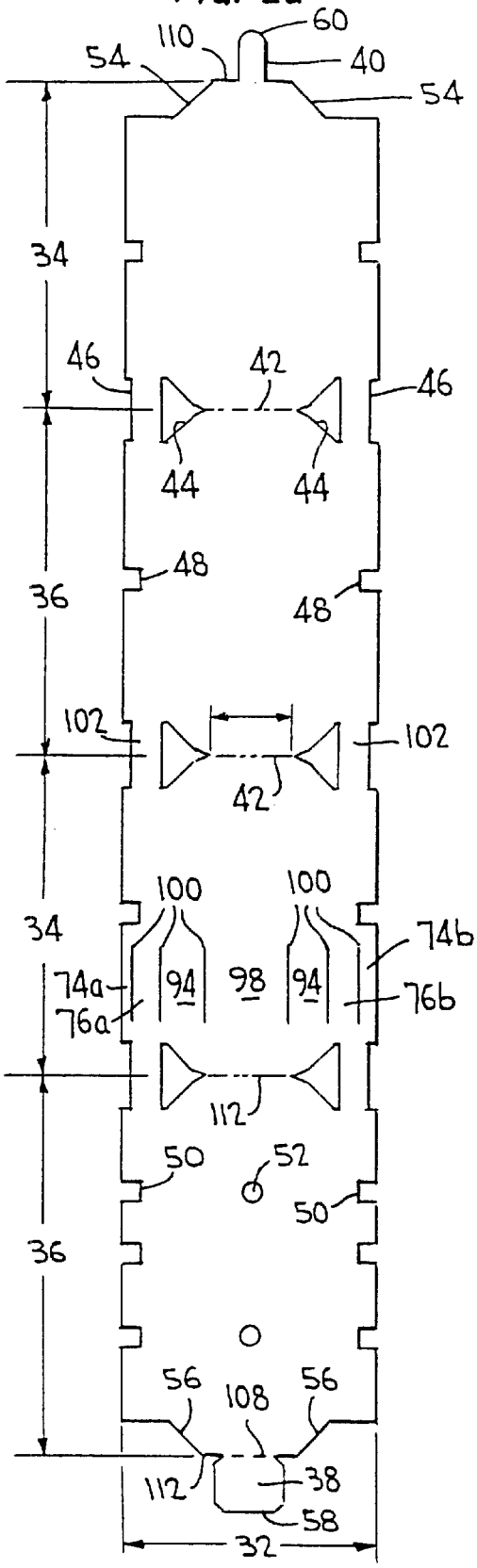
FIG. 2*a* is a plan view of the die-punched flat metal stock of the spacer of the present invention prior to roll-formation of the spacer.

FIG. 2*a* illustrates a fully punched individual spacer, still in flat-stock form, as it emerges at 24 from the punching station 20. Dimension 32 is the raw width of the spool 14 of flat stock and, as noted, is specifically selected in accordance with the particular spacer width being manufactured. Dimensions 34 and 36 define, respectively, the finished height and width of the spacer with the overall length of the flat stock being longer than the spacer perimeter (i.e., longer than twice the sum of dimensions 34 and 36) by an amount equal to the respective mating end tabs 38 and 40.

Still referring to FIG. 2, there are three interior "corner structure" punch patterns shown symmetrically disposed about each of the three fold lines 42. Each punch pattern is comprised of a pair of opposed triangular punch-outs 44 (i.e., the material within the triangular region being removed) and a pair of opposed elongated notches 46. All four of the punch-outs associated with each punch pattern (i.e., again, the four punch-outs located along a single fold line) are formed in the spacer at one time by reason of the die-punching operation of one of the above-described die heads 26, 28, or 30. Following the die-stamping of the first inner corner punch pattern, the spacer stock is moved and again stopped under the die head whereafter the second corner punch pattern is stamped and, again, for the third corner.

Each opposed pair of notches 48 may similarly be placed in the spacer stock by the above-described "step and repeat" movement of the stock synchronized to the appropriate punching head. Notches 48 principally serve to locate and retain muntin structures, although such notches are not necessary to the invention. Notches 50 and holes 52 may also be used in connection with the evacuation and filling of the IGU with inert, dry gases.

Finally, the associated end structures, including the respective mitered edges 54 and 56 and the interlocking tabs 38 and 40 are punched at, and by, the single punch head 30. To fully appreciate this last punching operation, it must be remembered that, prior to severing, the trailing end 58 of tab 38 of a first spacer remains interconnected to the leading edge 60 of tab 40 of the next successive spacer. Thus, although defined on successive spacers, a pair of end structures, defined by tabs 38 and 40 and by edges 54 and 56 are, in fact, in adjoining proximity and are therefore stamped by a single stamping head. In similar manner it will be understood that each trailing end 58, in fact, defines the leading end 60 of the next spacer and therefore severing of the spacers occurs along the line defined at 58 and 60.

Figure 2B:
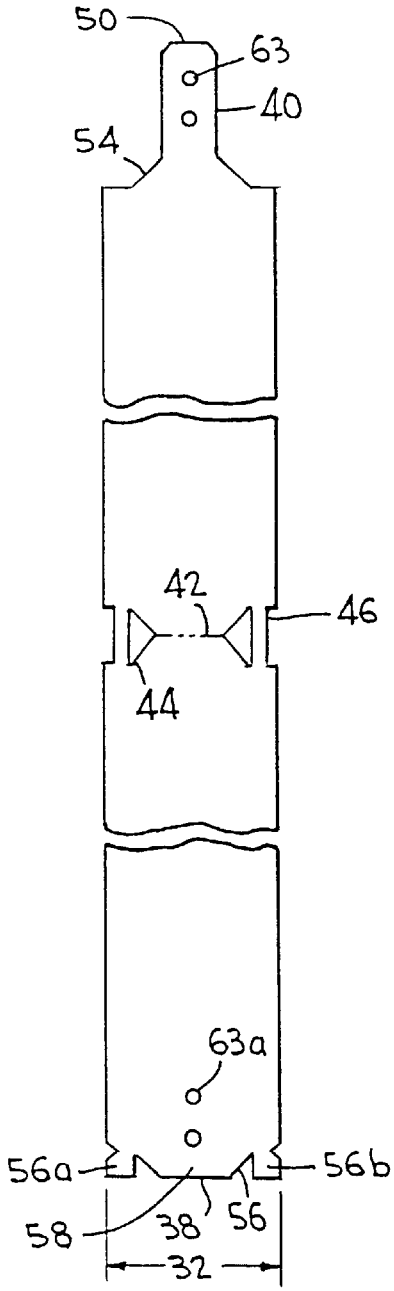
FIG. 2*b* is a partial plan view of the die-punched flat metal stock of the spacer of the presently preferred embodiment of the present invention prior to roll-formation of the spacer.

FIG. 2*b* illustrates a presently preferred embodiment of a fully punched individual spacer similar to FIG. 2*a* with like numbers representing similar portions as shown in FIG. 2*a*. However the spacer does not include notches 48 and 50, and therefore, does not require the die-punching operation necessary to make these notches. The spacer of this configuration uses a similar type tab 40 for connecting the ends of the spacer. Tab 40 includes holes 63 for connection for mating with holes 63*a* at the spacer end.

Referring again to FIG. 1, the completely punched spacer (of FIG. 2) exits onto one or more conveyors 62. The number of conveyors utilized is determined only by the standard lengths of conveyors commercially available and, importantly, the largest spacer perimeter for which the system 10 shall be designed. It will be appreciated that sufficient conveyor length must be provided to accommodate the longest spacer to be manufactured. A minimum conveyor length of 24 feet would be required, for example, to fabricate a spacer for an 4'×8' sliding glass door. The conveyors are of generally conventional design. However, guide bars (not shown) may advantageously be positioned near the end of the last conveyor to direct the spacer properly into the inlet of the roll-forming station 64.

Figure 3:
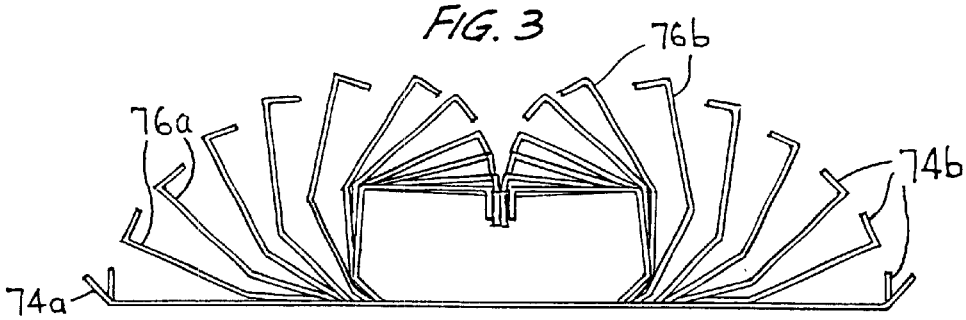
FIG. 3 is a vertical end-view of the spacer stock showing the transformation of the spacer stock cross-section as it progresses through roll-forming, depicted in a composite overlay view.
Figure 4:
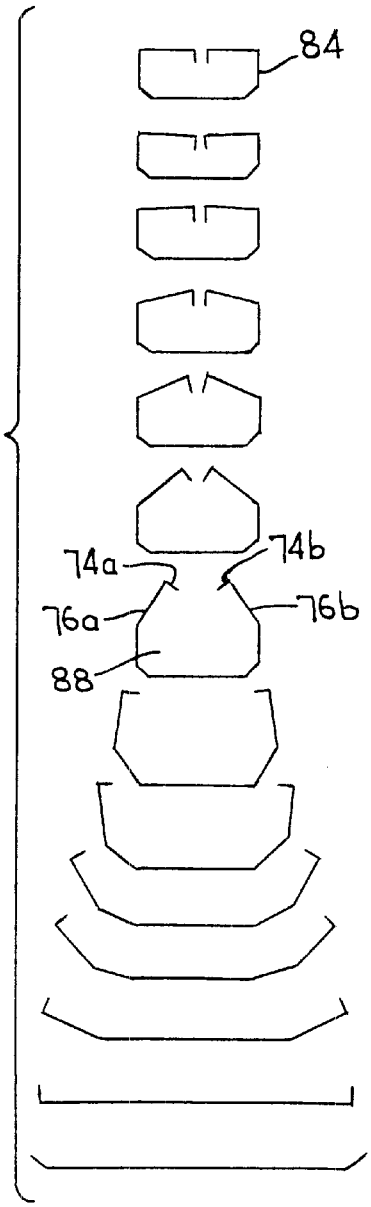
FIG. 4 is a vertical end-view of the spacer stock showing the transformation of the spacer stock cross-section as it progresses through roll-forming, depicted in separate views.

Roll-forming represents a well-known and preferred arrangement for literally converting the flat stock (e.g. of FIG. 2) into virtually any desired spacer cross-section. A plurality roll-forming dies are placed in adjacent relationship—each acting on the sheet metal in turn to gradually convert the shape thereof. FIGS. 3 and 4 illustrate a multiple station roll-former and the cross-section of the sheet metal as it passes through each station. Further, multiple sets of roll-forming dies, preferably three, may be placed on a single set of driven axles and appropriately indexed thereby facilitating fabrication of three separate spacer profiles or sizes simply by moving the roll-former laterally to position and expose one of the other sets of roll-former dies.

It should be stressed that the cross-sections of FIGS. 3 and 4 are merely illustrative and that other contours may be formed by appropriate design of the roll-former. For example, another preferred cross-section is that shown in FIG. 5*a* in which inwardly extending ridges 66 and non-planar upper 68 and lower 70 sidewall portions are provided to promote additional rigidity and sealant capacity to, and around, the spacer. A gap 72 may advantageously be defined between flanges 74*a,b*, which flanges are formed along the opposed edges of spacer inner surfaces 76*a,b* as shown.

Figure 5A:
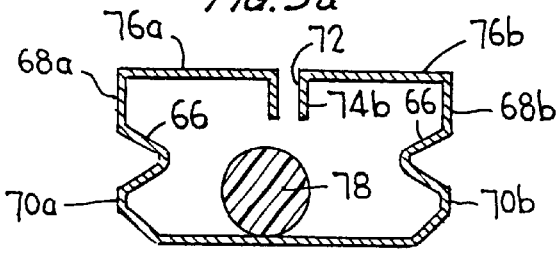
FIG. 5*a* is a vertical end view of a preferred embodiment of the spacer of the present invention.

This gap permits communication of gas between the interior of the IGU and the desiccant (which desiccant is shown in FIG. 5*a* as rope or cord material 78) as required to assure that any latent moisture within the IGU shall be properly absorbed by the desiccant. Gap 72 further acts as a thermal barrier to the transmittal of heat energy between the "a" and "b" sides of the spacer. It is well known that substantial portions of the heat energy transmitted through a spacer is communicated through the "thermally-conductive" metallic portions thereof. Gap 72 substantially increases the thermal resistance across the inner spacer surface 76.

Figure 5B:
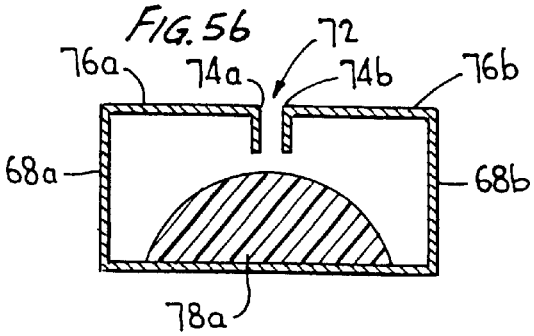
FIG. 5*b* is a vertical end-view of an alternative embodiment of the spacer of the present invention.

FIG. 5*b* shows the presently preferred spacer frame cross-section and having a hot melt desiccant 78*a* as discussed hereafter.

Returning to FIG. 1, the flat, but punched, spacer stock of FIG. 2 enters the roll-former at station 64 and progresses therethrough until it exits at 82 as a single, integral and linear piece of spacer stock of cross-section, for example, as shown in FIGS. 5*a* or 5*b*. Due to the substantially closed cross-sectional form of the spacers thusly depicted, it is preferable to place the required desiccant into the spacer interior, channel region during the roll-forming process, that is, while the spacer remains open.

In the preferred embodiment of the present invention, a desiccant-containing material 78*a* is proposed. The preferred method of desiccant application is a hot melt system applied as discussed hereafter. The hot melt is designed to have no adhesion properties to the spacer material. The idea behind this is to manufacture the rope at the point of application to the spacer. This method makes insertion into the spacer simpler, controls any air constant with desiccant prior to application because it is held within the pumping circuit, and profile of bead in spacer is controllable via nozzle design.

It is preferred that the desiccant be laid or injected into the spacer during the roll-formation thereof, that is, while the flanges 74 of the inner surface 76 remain spaced apart a sufficient distance to admit application of the desiccant therein.

FIG. 1 illustrates a desiccant feeder 86 to insert, or lay, the desiccant into the spacer at, for example, roll-forming station 64 of FIG. 4. In view of the closed-form of the present spacer, only so much desiccant need be inserted into the spacer as technically dictated by industry standards taking into account the size of the IGU and other relevant considerations. In short, feeder 86 may advantageously limit application of the desiccant to less than the full perimeter of the IGU.

While the spacer profile is still substantially open a nozzle assembly 110 is inserted into the semi-formed spacer. Nozzle assembly 110, shown in FIGS. 1, 10 and 11, comprises a heated dispensing valve 112 and nozzle 114. This nozzle assembly applies a hot liquid desiccant into the moving product. The nozzle assembly is specially designed for two specific purposes. First, it creates a low profile bead of desiccant 78*a*, necessary for subsequent operations, and second it has a specially designed shut-off system to minimize "tail out" of the desiccant. This condition can cause the desiccant to appear out the end of the spacer, and is objectionable.

A special flow meter 89 is installed in the desiccant circuit to measure the volume of desiccant dispensed into the spacer. This feedback is used in calculation of window area to determine the correct shut-off point for each spacer. Depending on the area of the window, desiccant may be present in one, two, three, or four sides. Since the profile is closed and the desiccant is not visible, there is no requirement for a fully filled spacer. Thus, the amount of desiccant is determined by individual window requirements, not sight or length.

The preferred desiccant is manufactured by Tru-Seal Technologies, Inc. of Beachwood, Ohio., and sold under the designation RL-50. The preferred nozzle assembly includes a heated dispensing valve assembly manufactured by Graco Co. of Minneapolis, Minn., and a nozzle manufactured by Iowa Precision Industries of Cedar Rapids, Iowa. The preferred flow meter is manufactured by Kuppers Electro-Mechanik GMBH, Karlsfeld, Germany, and sold under the designation Model #SRZ-40-03ET+VTER.

The nozzle 114 has been specifically designed for the desiccated spacer application to be used in conjunction with the heated dispenser valve assembly 112. The nozzle assembly 110 is particularly useful for avoiding two problems in dispensing the desiccant through the nozzle.

First, the desiccant had a viscosity which may create the "tail out" condition discussed above. To minimize this condition there must be a minimum of desiccant material in the nozzle 114 beyond the dispense valve shut-off point 116. The nozzle includes an extended shut-off rod 118 to mate with the nozzle 114. This moves the shut-off point close to the actual dispensing joint and avoids the "tail-out" condition.

Second, is the actual shape of the desiccant bead. The width as well as the height must be controllable. The width is adjusted by rotating the nozzle 114 on its centerline. Two dispensing holes 120*a,b* at the tip of the nozzle are turned in relation to the feed direction of the roll-former. If the two holes are in line with the feed direction, the narrowest possible bead is made. As the holes are rotated away from the feed direction, a correspondingly wider bead is delivered. The height of the bead is controlled by the volume of material per unit time (adjustable via the standard Graco dispensing valve components), and the distance of the nozzle to the surface the desiccant is to be applied to.

In another embodiment of the present invention, a desiccant-containing rope or cord 78 is proposed. Desiccant ropes are commercially available and have found prior IGU application. And while this cord may be inserted into the spacer after it is fully roll-formed (prior to the folding of the linear spacer stock into its final rectangular form); it is preferred that the desiccant be laid or injected into the spacer during the roll-formation thereof, that is, while the flanges 74 of the inner surface 76 remain spaced apart a sufficient distance to admit application of the desiccant rope or other desiccant therein. A desiccant rope feeder may be employed to insert, or lay, the desiccant rope into the spacer at, for example, roll-forming station 64 of FIG. 4. In view of the closed-form of the present spacer, only so much desiccant need be inserted into the spacer as technically dictated by industry standards taking into account the size of the IGU and other relevant considerations. In short, the desiccant feeder may advantageously limit application of the desiccant rope to less than the full perimeter of the IGU—two sides being deemed sufficient in many instances.

Figure 6:
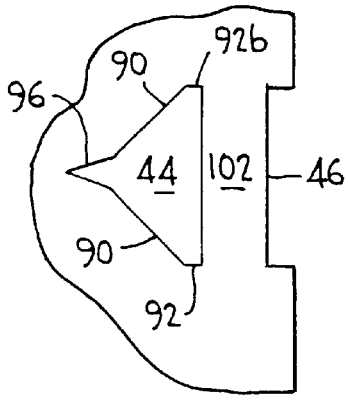
FIG. 6 is a fragmentary view of the flat metal spacer stock of FIG. 2 depicting details of the inner corner punch pattern.
Figure 7:
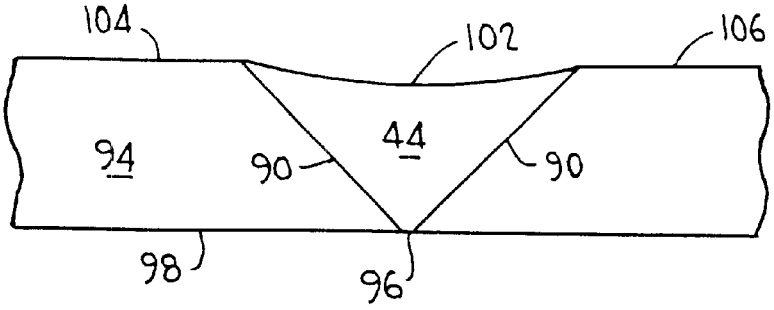
FIG. 7 is a fragmentary side elevation view depicting the inner corner of the roll-formed spacer of the present invention prior to the ninety degree folding formation of the corner.
Figure 8:
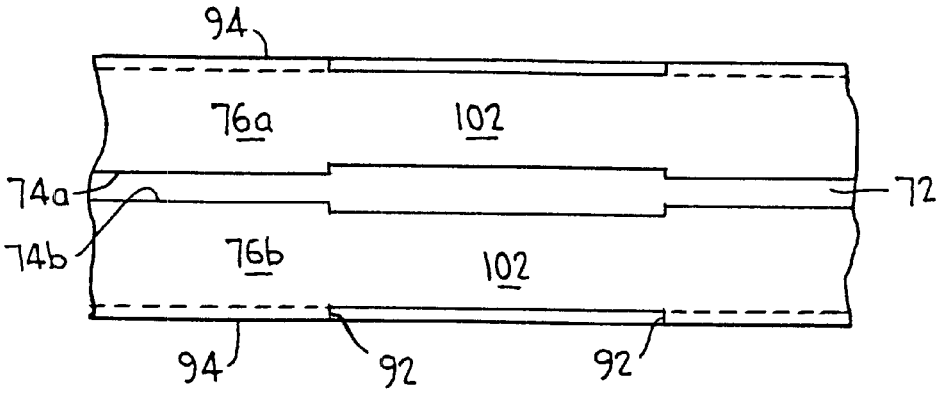
FIG. 8 is a fragmentary top plan view of the inner corner of FIG. 7.

Reference is again made to the punched spacer of FIG. 2, the inset drawing of FIG. 6, and FIGS. 7–9 in connection with the interior corner structures of the present invention. FIG. 6 is an enlarged, fragmentary view of one-half of an inner corner punch pattern including elongated notch 46 and triangular punch-out 44. Punch-out 44 finds its principal definition in the two 45 degree tapered edges 90 that abut, upon corner folding, to form the fully mitered spacer sidewall corner of FIG. 9. Two perpendicular extensions 92 are added to the otherwise triangular punch-out 44 and form a part of the radiussed corner which defines the edge between each spacer sidewall 94 and inner surfaces 76*a,b* and which form rectangular extension portions as shown in FIG. 8. For similar reasons, the vertex 96 has been exaggerated and extended to form a vertex extension portion and define the radiussed edge between sidewalls 94 and spacer bottom surface 98. Referring to FIG. 2*a*, line segments 100 depict the boundaries between the respective spacer bottom surface 98, sidewalls 94, inner surfaces 76*a,b*, and flanges 74*a,b*.

FIGS. 6–8 best illustrate the bridges 102 of the present invention which, as noted, literally "bridge" across the corner region (i.e., the gap defined within the corner region prior to corner formation) thereby integrally interconnecting the respective spacer inner surface ends of adjacent spacer segments 104 and 106. By reference to FIG. 7, it will be seen that bridges 102 are located at the uppermost portion of the spacer (inner surface), that is, at the furthest spaced-apart distance from the bottom surface 98 thereby forming two spaced-apart points of interconnection between the adjacent spacer segments 104 and 106. These spaced-apart points define, in turn, an important moment-arm that resists the torsional movement between such adjacent segments. This may be favorably contrasted to the Besten-type fully mitered corner which, in the absence of bridges 102, defines only a single point of interconnection between adjacent spacer segments, i.e., along the bottom surface 98 at the corner fold (at 96 of FIGS. 7 and 9).

FIG. 7 further reveals another feature of the present spacer and spacer manufacturing system. It will be apparent that bridges 102 droop slightly toward the interior of the spacer. This drooping is not caused by deliberate process apparatus or steps, but rather, by the fortuitous consequence of the roll-forming process itself whereby the final roll-forming dies required to complete the spacer cross-section, e.g. at 84 of FIG. 4, place a downward bias on the inner surfaces 76 of the spacer which, in turn, push the unsupported portions of the inner surfaces, i.e., the bridges 102, downwardly.

Figure 9:
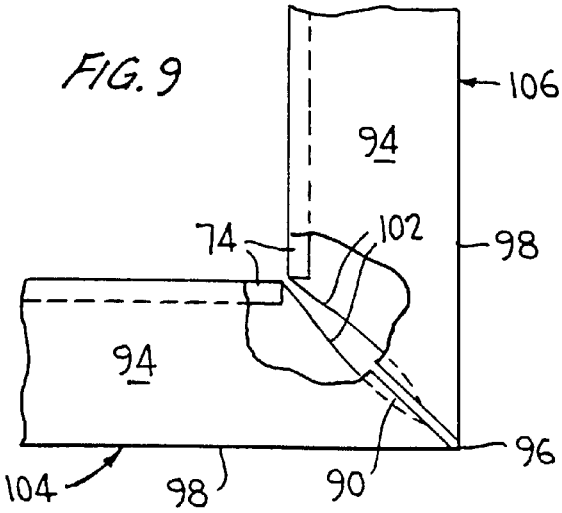
FIG. 9 is a fragmentary side elevation view of the inner corner of FIG. 7 after the ninety degree folding formation thereof.

As a consequence of this slight inward deformation, bridges 102 fold inwardly together as shown in FIG. 9 thereby substantially closing off the interior of the spacer and precluding movement of desiccant material between adjacent spacer segments. With particular reference to the desiccant, the inwardly deflected bridges engage the desiccant thereby locking it against longitudinal movement within the spacer.

Various arrangements for securing and locking the distal ends of the spacer to form the fourth corner may be employed. As illustrated in FIG. 2*a*, one embodiment includes a pair of mating tabs 38 and 40 with a slot 108 in tab 38 to receive tab 40 therethrough. Respective end edges 110 and 112 are brought into abutting contact with the tabs thereafter being bent downwardly at ninety degrees against respective adjacent sides to lock the forth corner.

A preferred embodiment for securing and locking the distal ends of the spacer is illustrated in FIG. 2*b* in which tab 40 is inserted into spacer. Tabs 56*a* and 56*b* are bent down into the spacer profile, almost in contact with area 58. The tab 60 is bent at a 90 degree angle and inserted into the space created by tabs 56*a*, 56*b* and 58, creating the final assembly of the spacer frame. A screw or rivet is inserted through hole 63*a* into hole 63, which align after the assembly described above, and completes the assembly.

The above-described completed spacer, with desiccant therein, may be delivered from the roll-former at 82 directly to a linear extruder or laminating apparatus (not shown) and thereafter folded and locked into its finished rectangular form and assembled into an IGU. As noted previously, the above-described spacer fabrication process can be bifurcated, that is, separated into its constituent steps including, for instance, the die-punching of the flat stock and the roll-forming of the punched stock.

In similar fashion, the completed spacers (i.e., punched and roll-formed) may be bundled for transport to the sealant extruder or for later application of sealant and final IGU fabrication. Of course, if the final IGU fabrication steps are postponed, the spacers described herein must be maintained in a dry environment whereby the desiccant will not become moisture contaminated or, as noted above, the application of the desiccant can be delayed and inserted into the spacer ends just prior to final IGU fabrication.

While the preferred embodiments have been described, various alternative embodiments may be utilized within the scope of the invention which is limited only by the following claims and their equivalents.

What is claimed is:

1. A method of making a window spacer comprising the steps of roll-forming a flat piece of metallic sheet material to provide a spacer stock member comprising a continuous bottom surface along substantially the full length of the metal member, opposed parallel sidewalls extending perpendicularly from the bottom surface and extending along substantially the full length of the metal member, the sidewalls having notches therein that extend the full height of the sidewall from an upper edge thereof downwardly to the bottom surface, the sidewall notches being disposed at, and defining, corner regions of the spacer when the spacer stock is folded, the sidewall notches being further defined in pairs whereby each sidewall defines substantially identical sidewall notches, inner wall members in parallel spaced-apart relationship to the bottom surface and extending substantially along the entire length of the metal member, the inner wall members being continuous along at least the corner regions thereby defining bridge members in the corner regions adjacent the sidewall notches whereby both the bottom surface and the spaced-apart inner wall members define continuous points of interconnection throughout the corner region.

2. The method of claim 1 wherein said notches are triangular in shape.

3. The method of claim 1 including the step of positioning a desiccant into said spacer.

4. The method of claim 2 wherein the desiccant is positioned in said spacer prior to completing the roll-forming of said spacer.

5. The method of claim 4 wherein the desiccant is a hot melt desiccant.

6. The method of claim 5 wherein the desiccant is positioned in said spacer by a nozzle.

7. The method of claim 6 wherein the amount of desiccant positioned in said spacer is controlled by a flow meter.

8. A method of making an insulated glass unit comprising the steps of roll-forming a metallic spacer stock member, said spacer comprising a continuous bottom surface along substantially the full length of the metal member, opposed parallel sidewalls extending perpendicularly from the bottom surface and extending along substantially the full length of the metal member, the sidewalls having notches therein that extend the full height of the sidewall from an upper edge thereof downwardly to the bottom surface, the sidewall notches being disposed at, and defining, corner regions of the spacer when the spacer stock is folded, the sidewall notches being further defined in pairs whereby each sidewall defines substantially identical sidewall notches, inner wall members in parallel spaced-apart relationship to the bottom surface and extending substantially along the entire length of the metal member, the inner wall members being continuous along at least the corner regions thereby defining bridge members in the corner regions adjacent the sidewall notches whereby both the bottom surface and the spaced-apart inner wall members define continuous points of interconnection throughout the corner region and securing glass sheets to said spacer.

9. The method of making an insulated glass unit of claim 8 comprising the step of positioning a desiccant in said spacer.

10. The method of claim 8 wherein said notches are triangular in shape.

11. The method of claim 9 wherein the desiccant is positioned in said spacer prior to completing the roll-forming of said spacer.

12. The method of claim 11 wherein the desiccant is a hot melt desiccant.

13. The method of claim 12 wherein the desiccant is positioned in said spacer by a nozzle.

14. The method of claim 13 wherein the amount of desiccant positioned in said spacer is controlled by a flow meter.

* * * * *